US006381834B1

(12) United States Patent
May

(10) Patent No.: US 6,381,834 B1
(45) Date of Patent: May 7, 2002

(54) METHOD FOR DAMPENING ACOUSTICAL NOISE IN A DRY-TYPE TRANSFORMER

(75) Inventor: Scott Edwards May, Matthews, NC (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 08/955,811

(22) Filed: Oct. 22, 1997

Related U.S. Application Data

(62) Division of application No. 08/823,848, filed on Mar. 25, 1997, now abandoned, which is a continuation of application No. 08/494,042, filed on Jun. 23, 1995, now abandoned.

(51) Int. Cl.[7] ..... H01F 41/12

(52) U.S. Cl. ..... 29/606; 29/602.1

(58) Field of Search ..... 29/605, 606, 609, 29/609.1; 336/60, 196, 207, 100

(56) References Cited

U.S. PATENT DOCUMENTS

| | | | |
|---|---|---|---|
| 3,579,164 A | 5/1971 | Rotruck | 336/100 |
| 3,792,397 A | 2/1974 | Reinemann | 336/92 |
| 4,047,138 A | 9/1977 | Steigerwald | 336/100 |

OTHER PUBLICATIONS

T. R. Specht—"Noise Levels of Indoor Transformers" Oct. 1955. "Consulting Engineer" pp. 50–53.

*Primary Examiner*—Carl E. Hall
(74) *Attorney, Agent, or Firm*—Michael J. Femal; Larry I. Golden

(57) ABSTRACT

A dry-type power transformer has a lower acoustical noise level by inserting sound absorbing pads at predetermined locations in an air gap formed longitudinally between a low voltage coil and its corresponding leg member of the transformer's iron core. The pads function as baffles to lower the acoustical noise caused by magnetostriction and other forces when the transformer is energized. The pads are arranged in alternate patterns between the top and the bottom of the air gap.

4 Claims, 3 Drawing Sheets

METHOD FOR DAMPENING ACOUSTICAL NOISE IN A DRY-TYPE TRANSFORMER

RELATED APPLICATION

This is a divisional application of, U.S. patent application Ser. No. 08/823,848, filed Mar. 25, 1997, now abandoned, which is a continuation of U.S. patent application Ser. No. 08/494,042, filed Jun. 23, 1995, now abandoned.

TECHNICAL FIELD

Applicant's invention relates generally to dry-type transformers having a ferromagnetic core, a high voltage winding, and a low voltage winding, and more particularly, to a method of reducing audible sound radiating from the transformer.

BACKGROUND ART

A transformer generally consists of a laminated, ferromagnetic core, high voltage windings, and low voltage windings. It is well known that transformers emit a certain level of audible noise. If a transformer is located outdoors, the noise level can be considerably higher than one that is located indoors. A power transformer located in a school or office building could be quite distracfful if it gave off excessive noise. A majority of the noise is caused by magnetostriction of the core laminations when the transformer is energized. The elastic deformation of the core that accompanies this energization occurs at a rate twice the line frequency. These deformations cause the individual core laminations to vibrate as they change shape due to the elastic deformation. This causes air columns to be formed in the spaces between the core and the windings and other adjacent parts of the transformer and its enclosure, if one is present. These air columns will cause audible sound as they move between the various parts of the transformer. The sound level is affected by the line frequency, the ambient sound level, and the surrounding environment.

Controlling the noise level of indoor installations can become quite expensive if it is done at the installation itself. For example, a separate sound-proofed room could be built around the installation. This may not be practical and it would be a better solution to control noise within the transformer itself. Sound is transmitted from the transformer to the rest of the installation due to vibration if the transformer is in direct contact with solid structural elements such as the floor or walls. Radiated sound through air may impinge on surrounding walls, causing them to vibrate and transmit sound on the other side of the wall. Sound can also travel through conduit and other electrical connecting means, and through heating and ventilating equipment. Various methods have been implemented as standard manufacturing and engineering practices to reduce noise levels. These methods include manufacturing controls of the core laminations to reduce the effects of magnetostriction by maximizing flatness and minimizing stresses of the laminations and insuring good core joints. The laminations may be cemented or coated. High silicon content steel could be used as the core material. Reducing the induction of the transformer will also reduce the effects of magnetostriction. This, however, increases the size, weight, and cost of the transformer.

It has been understood that noise emission is dependent primarily on the power rating of the transformer and the flux density of its core. Transformer loading has, until recently, contributed little to the overall noise level. However, as the above improvements have been made to the core material, noise emitted from the load dependent windings becomes more of a factor. Load noise, the additional noise emitted above the no-load level, is caused by the electromagnetic forces that result from leakage fields surrounding the transformer that cause vibrations in the windings, shields, or the enclosure housing the transformer. Methods have been developed to reduce the noise levels caused these forces. These methods have been more adaptable to oil-filled transformers or those that are surrounded by a tank. By using thicker or double walled tanks, some of the generated noise can be self-contained. This has been found to be least effective and costly. Core vibration isolators can be used to interrupt the noise path between the transformer and the structural elements. In the case of an oil filled transformer, complicated designs of an effective restraining method are required to prevent damage to the transformer during shipping. Resilient absorbers have been applied to the interior surfaces of the tank walls so that the absorbers compress instead of the tank walls, thus reducing the vibrations on the walls caused by magnetostriction. These absorbers can be applied as a type of lining to the interior surfaces of the tank walls. The resilient lining is softer than the tank wall so that they can compress instead of the wall. Another method, as disclosed in U.S. Pat. No. 3,579,164, uses flexible fibers that have one end coupled to the core and to the tank walls. The loose ends are allowed to hang free so that they can absorb the energy from the air columns generated by the magnetostriction forces.

All of these methods have varying degrees of effectiveness, and are generally more applicable to liquid or gas filled transformers. It would be desirable to develop a system or method to reduce noise levels in dry-type power transformers that is more cost effective and is readily adaptable to present transformer design without having to modify the transformer enclosure.

SUMMARY OF THE INVENTION

Accordingly, the principal object of the present invention is to provide a transformer with a high voltage winding and a low voltage winding surrounding a core with reduced emitted noise which overcomes the above mentioned disadvantages.

A further objective of the invention is to provide a method for manufacturing a transformer with reduced emitted noise levels without modifying an enclosure which houses the transformer.

In one embodiment of the invention, the inner or low voltage coil is constructed using a VPI resin encapsulated process. The outer coil or high voltage coil is a cast resin coil and is also fabricated using a VPI process, with the chief difference being that the resin is poured into a mold containing the coil, allowing the curing to take place inside the mold. The transformer is then assembled by inserting the inner coil over an iron laminated core and then inserting the outer coil around the inner coil. Sound damping pads are installed in the air gap between low voltage coil and the iron core. They are placed in alternating patterns at the top and the bottom of the low voltage coil. The pads are constructed of a suitable material that has sound absorbing properties. The alternate pattern of the pads serve as an air baffle to the air column that is generated by the magnetostriction. The resultant assembly is then secured with appropriate clamps and mounting feet, along with terminal means for external connections.

Other features and advantages of the invention will be apparent from the following specification taken in conjunction with the accompanying drawings in which there is shown a preferred embodiment of the invention. Reference is made to the claims for interpreting the full scope of the invention which is not necessarily represented by such embodiment.

DETAILED DESCRIPTION

Although this invention is susceptible to embodiments of many different forms, a preferred embodiment will be described and illustrated in detail herein. The present disclosure exemplifies the principles of the invention and is not to be considered a limit to the broader aspects of the invention to the particular embodiment as described.

Figure 1:
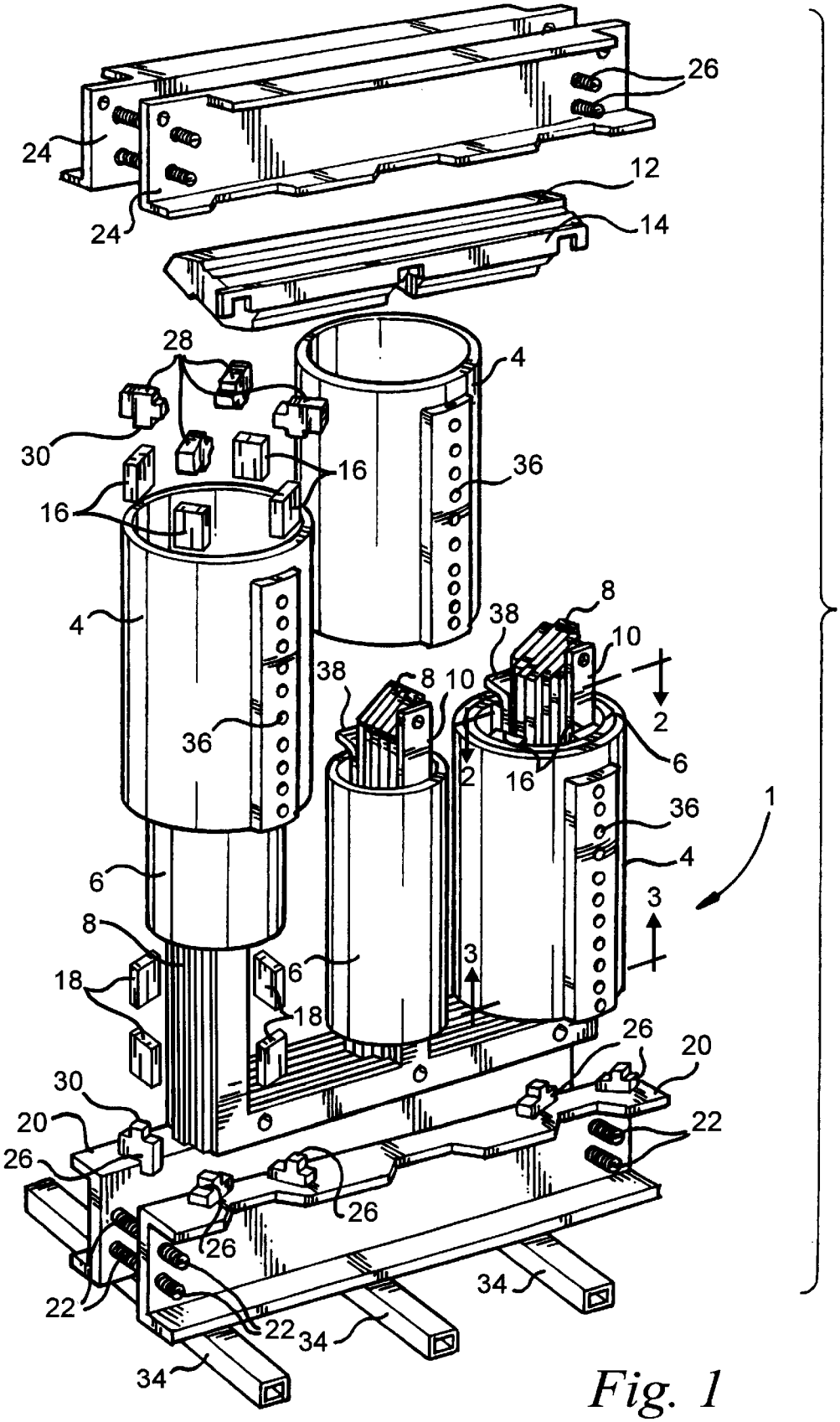
FIG. 1 is an exploded isometric view of a three phase dry-type high voltage transformer constructed according to the present invention.

FIG. 1 illustrates a typical three phase transformer 1 constructed according to the preferred embodiment. Although a three phase transformer is shown, it is to be understood that the invention is not to be limited to a three phase construction. Power transformers are configured as two or more legged devices and the present invention is adaptable to any configuration having an iron core circumvented by coils. A high voltage coil 4 surrounds a low voltage coil 6. The high voltage coil 4 is constructed using a VPI cast resin process, the details of which are well known and are therefore not an object of this invention. U.S. Pat. No. 4,523,171 discloses one such method. The low voltage coil can be constructed in a similar manner. Other coil construction processes are possible and the present invention is not to be restricted to any particular type of coil construction. A core 8 is formed in the the shape of a cruciform from laminated straps of iron for ease of manufacturing. A core locking strap 10 is added to the top of the stack. After the core laminations 8 are stacked, a series of banding straps could be used to keep the core legs compressed. During the loading of coils 6, 8, the bands are cut as they are lowered into position. This causes the core legs to expand, interfering with the procedure. The expanded core legs result in increased core noise and losses. To improve this method, instead of banding straps, core compression and stabilization is accomplished with the use of a heat shrink film material with an elastic property that will hold the core leg in a constant uniform compression. The heat shrink material is wound around the core legs 8 and then heated to shrink the material tightly around the core legs 8. An alternative to the heat shrink material is to use some other type of film material or narrow tape having elastic properties and wrapping the material under tension around the core legs 8 to keep them under compression. After the core legs are thusly secured, an epoxy type paint is applied to exposed areas for environmental protection. An upper core yolk 12 is secured to the core 8 by mating strap 14 with core locking strap 10 after the low voltage coils 6 and high voltage coils 4 have been inserted over the three legs of the core 8. Four sound dampening pads 16 are placed 90 degrees apart between the core 8 and the low voltage coil 6 at the top and four more sound dampening pads 18 are placed at the bottom of the coil 6. Lower core clamp 20 holds and secures core 8 with mounting hardware 22. Upper core clamp 24 holds and secures upper core yolk 8 similarly with mounting hardware 22. Lower 26 and upper 28 mounting blocks support high voltage coil 4 and low voltage coil 6. Tab 30 of mounting blocks 26, 28 maintains an air gap 32 between the high and low voltage coils 4 and 6. Mounting feet 34 can be attached for stability. Terminal blocks 36 allow for high voltage connections and have provisions for selecting various voltage taps for a wide selection of input and cutput voltages. Terminals 38 provide the means for low voltage connections. A transformer thus assembled can accommodate input voltages up to 36 kV, With a power rating between 112.5–10,000 kVA.

Noise is caused by magnetostriction of the core laminations 8 while the transformer is energized. The elastic deformation of the core that accompanies this energization occurs at a rate twice the line frequency. These deformations cause the individual core laminations to vibrate as they change shape due to the deformation. This causes air columns to be formed in the spaces between the core 8 and the low voltage windings of core 6 and other adjacent parts of the transformer. These air columns will cause audible sound as they move between the various parts of the transformer. The sound damping pads 16, 18 will act as a baffle to the air columns. These pads can be made from any of a number of types of sound damping material that has a corresponding temperature rating compatible with the maximum transformer temperature rise. Tests have shown that placing four pads 16, made from a silicon rubber sponge, 90 degrees apart, in the gap between the top of the low voltage coil 6 and the core 8, and placing four pads 18, made from the same material, 90 degrees apart, alternately spaced in relationship with the pads 16, in the gap between the bottom of the low voltage coil 6 and the core 8, provides optimum results in the reduction of the audible sound levels.

Figure 2:
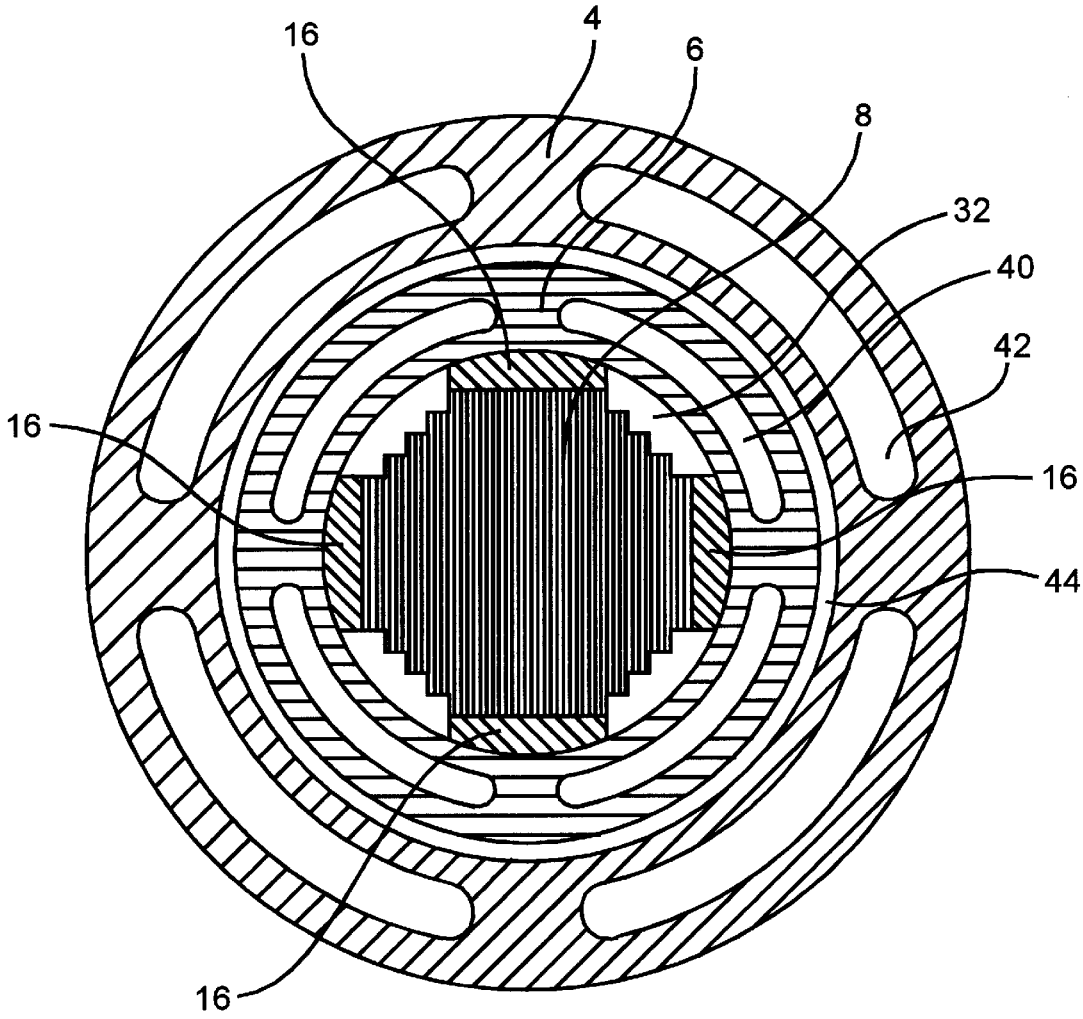
FIG. 2 is a cross sectional top view of a core surrounded by a low voltage coil and a high voltage coil of the type depicted in the transformer of FIG. 1 constructed according to the present invention.

Referring to FIG. 2, a partial cross sectional top view of the core 6 surrounded by the low voltage coil 6 and the high voltage coil 8 as shown in the transformer 1 of FIG. 1 is depicted according to the present invention. The air gap 32 has four sound absorbing pads 16 placed 90 degrees apart. The pads 16 are made of insulating material, such as rubber and are compressible to hold them in place. The low voltage coil 6 and high voltage coil 4 have cooling channels 40, 42, respectively. No sound absorbing material is placed in these channels. The air gap 44 between the high voltage coil 4 and low voltage coil 6 could be further filled with some of the sound absorbing pads 16. However, because of the possible high voltage potential between the high and low voltage coils, there is the possibility of creepage across the pads that could cause tracking between the two coils 4 and 6. Therefore, it is not advisable to use sound damping pads in the air gap between the two coils.

Figure 3:
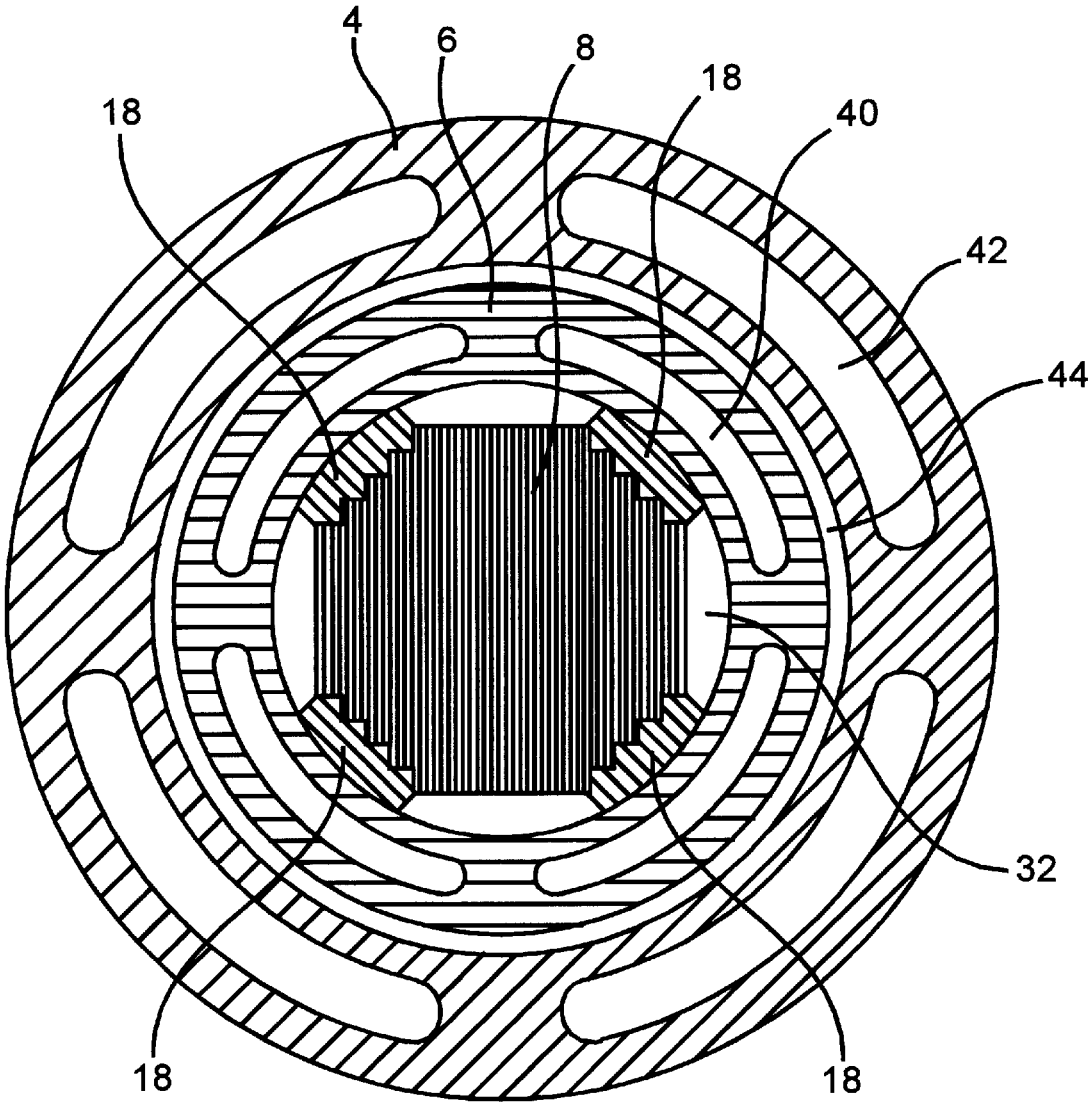
FIG. 3 is a cross sectional bottom view of a core surrounded by a low voltage coil and a high voltage coil of the type depicted in the transformer of FIG. 1 constructed according to the present invention.

Similarly, FIG. 3 shows a partial cross sectional bottom view of the core 6 surrounded by the low voltage coil 6 and the high voltage coil 8 depicted in the transformer 1 of FIG. 1. The air gap 32 has four sound absorbing pads 18 placed 90 degrees apart. The pads 18 are from the same insulating material as pads 16 and are displaced 45 degrees from the pads 16. Low voltage coil 6 and high voltage coil 4 have cooling channels 40, 42, respectively. The air gap 44 between the high voltage coil 4 and low voltage coil 6 is open, as discussed above. With the top pads 16 and the bottom pads 18 staggered in an alternating pattern between top and bottom, air flow through the air gap 32 is obstructed.

There are no direct, unobstructed air paths. The air column created in the air gap 32 by magnetostriction is baffled by the staggered pads 16, 18 resulting in a reduced noise level.

Sound level tests for a 1500 KVA dry type transformer, conducted in accordance with ANSI Standard C57.12.91, were taken using different types of sound damping material and configurations. The transformer under test had a 1.5 inch air gap between the core and the low voltage. The low voltage winding was back-fed at rated voltage to simulates an unloaded transformer. The results are tabulated in Table 1. The sound level includes the combination of the transformer noise and the ambient noise. All sound level readings have been corrected to ambient and represent an average of several readings. The paper test involved stuffing the air gap with newspapers and loosening all of the nuts and bolts and mounting blocks of the transformer assembly so as to eliminate any effects due to mechanical stresses. Tests were conducted at different times so that the ambient sound level also represents an average. The results shown in Table 1 are meant to be illustrative only.

TABLE 1

| METHOD | SOUND LEVEL (dB) |
|---|---|
| NONE | 77.5 |
| PAPER | 60.7 |
| FOAM 1 LAYER | 71.9 |
| FOAM 2 LAYERS | 68.3 |
| 6 SPONGE PADS | 67.5 |
| 8 SPONGE PADS | 64.7 |
| AMBIENT | 54.0 |

Without any material introduced into the air gap, the total sound level reached 77.1 dB. The foam layer was a 2 inch thick sponge wrapped once or twice around the low voltage coil. Six sponge pads, made of silicon rubber were placed alternately, three at the top and three at the bottom of the coil, 120 degrees apart. The eight sponge pads, made from the same material, and representative of the preferred embodiment, were placed 90 degrees apart, as shown in FIGS. 2 and 3. For each of the methods shown, there is a significant drop in the sound level. Whereas paper appears to provide the greatest reduction, this requires that the whole air gap be stuffed with paper or similar material. This restricts airflow and will result in an increased temperature rise of the transformer which could have other adverse effects on the operation of the transformer. Paper or similar material also will not have a sufficient temperature rating to be a viable or practical element in the sound damping system. The use of the foam layers also represents a solution that has unfavorable side effects in that air flow for cooling purposes is again restricted. The eight pad system provides a simple and efficient noise reduction system, yet does not restrict air flow for cooling purposes.

While the specific embodiments have been illustrated and described, numerous modifications are possible without departing from the scope or spirit of the invention.

I claim:

1. A method of lowering acoustical noise in a power transformer having an iron core with a plurality of cylindrical leg members, each of said legs encircled longitudinally by a low voltage coil, and a high voltage coil encircling said low voltage coil, said method comprising inserting sound absorbing pads at predetermined locations in a void formed longitudinally by said low voltage coil and its corresponding leg member of said iron core, said pads each having a first side and a second side, said first side of each said pad abutting said low voltage coil and said second side of each said pad abutting the corresponding leg member, said pads functioning as baffles to lower said acoustical noise, said predetermined locations located in an upper portion and a lower portion of said void.

2. The method of lowering acoustical noise in a power transformer of claim 1 wherein said sound absorbing pads are alternately spaced in said upper portion and said lower portion of said air gap.

3. The method of lowering acoustical noise in a power transformer of claim 2 wherein said sound absorbing pads include four pads located in said upper portion and four pads located in said lower portion of said air gap.

4. The method of lowering acoustical noise in a power transformer of claim 2 wherein said sound absorbing pads are silicone rubber based.

* * * * *